US008955586B1

(12) United States Patent
Randa et al.

(10) Patent No.: US 8,955,586 B1
(45) Date of Patent: Feb. 17, 2015

(54) BEACON ASSEMBLY

(75) Inventors: Mark D. Randa, Summit, WI (US); Robert F. Crane, Oconomowoc, WI (US); Steven W. Wentworth, Fountain Hills, AZ (US)

(73) Assignee: Earth Tool Company, LLC, Oconomowoc, WI (US)

( * ) Notice: Subject to any disclaimer, the term of this patent is extended or adjusted under 35 U.S.C. 154(b) by 389 days.

(21) Appl. No.: 13/357,226

(22) Filed: Jan. 24, 2012

Related U.S. Application Data

(60) Provisional application No. 61/435,664, filed on Jan. 24, 2011.

(51) Int. Cl.
*E21B 47/013* (2012.01)
*E21B 47/024* (2006.01)

(52) U.S. Cl.
USPC ..... 166/250.11; 166/255.2; 175/45; 175/62

(58) Field of Classification Search
USPC ..... 175/40, 45, 61, 19, 320, 308, 62, 398; 166/250.11, 255.2, 255.1
See application file for complete search history.

(56) References Cited

U.S. PATENT DOCUMENTS 5,899,283 A * 5/1999 Cox ..... 175/376
5,931,240 A * 8/1999 Cox ..... 175/73
5,950,743 A * 9/1999 Cox ..... 175/61
6,148,935 A * 11/2000 Wentworth et al. ..... 175/398
6,260,634 B1 * 7/2001 Wentworth et al. ..... 175/61
6,263,983 B1 * 7/2001 Wentworth et al. ..... 175/19
6,349,778 B1 * 2/2002 Blair et al. ..... 175/73
6,390,087 B1 * 5/2002 Wentworth et al. ..... 125/19
6,422,782 B1 * 7/2002 Wentworth ..... 403/353
6,470,979 B1 * 10/2002 Wentworth et al. ..... 175/320
6,581,680 B1 * 6/2003 Wentworth ..... 166/65.1
6,588,515 B2 * 7/2003 Wentworth et al. ..... 175/19
6,827,158 B1 * 12/2004 Dimitroff et al. ..... 175/62
7,036,609 B2 * 5/2006 Michael et al. ..... 175/19
7,121,363 B2 * 10/2006 Michael et al. ..... 175/45
7,172,035 B2 * 2/2007 Michael et al. ..... 175/19
7,331,409 B2 * 2/2008 Cole et al. ..... 175/45
7,600,582 B2 * 10/2009 Wright et al. ..... 175/40
7,624,816 B2 * 12/2009 Cole et al. ..... 175/45
8,662,201 B1 * 3/2014 Wright et al. ..... 175/45
2002/0043408 A1 * 4/2002 Wentworth et al. ..... 175/398
2002/0060095 A1 * 5/2002 Wentworth et al. ..... 175/73
2003/0131992 A1 * 7/2003 Michael et al. ..... 166/255.2
2005/0115706 A1 * 6/2005 Cole et al. ..... 166/61
2005/0205299 A1 * 9/2005 Michael et al. ..... 175/45
2006/0151213 A1 * 7/2006 Michael et al. ..... 175/40
2007/0039756 A1 * 2/2007 Wright et al. ..... 175/40
2008/0121430 A1 * 5/2008 Cole et al. ..... 175/24
2012/0218863 A1 * 8/2012 Chau et al. ..... 367/82
2012/0235686 A1 * 9/2012 Wentworth ..... 324/338
2013/0168154 A1 * 7/2013 Webb ..... 175/325.5

* cited by examiner

*Primary Examiner* — Jennifer H Gay
(74) *Attorney, Agent, or Firm* — Tomlinson Rust McKinstry Grable

(57) ABSTRACT

An electronic transmitter assembly used in directional boring, the housing of the assembly being configured for receiving a beacon. The housing and cover of the assembly are configured to provide transmission windows along each side of the cover rather than in the center of the cover. The beacon contained within the housing is configured to have a forward isolator on one end and a rear isolator on the other end to isolate the beacon from shock during boring operations.

16 Claims, 5 Drawing Sheets

BEACON ASSEMBLY

CROSS REFERENCE TO RELATED APPLICATION

This application claims the benefit of provisional patent application Ser. No. 61/435,664 filed on Jan. 24, 2011, the entire contents of which are incorporated herein by reference.

FIELD OF THE INVENTION

The present invention relates to directional drilling, particularly to a beacon assembly for use in directional drilling.

SUMMARY OF THE INVENTION

The present invention is directed to a beacon assembly for use in directional boring. The beacon assembly comprises a housing, a cover, and a window. The housing comprises an opening to support a beacon within the housing. The opening comprises an edge having an opening notch formed therein. The cover comprises a first edge having a cover notch formed therein. The cover notches correspond to the opening notch so that the opening notch is proximate and substantially parallel to the cover notch when the cover is placed over the opening. The window is disposed between the opening notch and the cover notch.

The present invention is also directed to a method for isolating a beacon within a housing. The method comprises the steps of securing a forward isolator and a rearward isolator to opposite ends of the beacon. An opening within the housing is provided and configured for receiving the beacon. The opening comprises a forward and rearward end. The method also includes configuring the forward and rearward end of the opening to allow the forward end to mate with the forward isolator and the rearward end to mate with the rearward isolator. The method includes placing the beacon within the opening such that the forward isolator on the beacon mates with the forward end of the opening and the rearward isolator on the beacon mates with the rearward end of the opening.

The present invention is also directed to a horizontal directional drilling system. The horizontal directional drilling system comprises a rotary drive machine, a drill string, a beacon assembly, and a drill bit. The drill string is attached to the rotary drive machine at an uphole end of the drill string. The beacon assembly is attached to the downhole end of the drill string. The beacon assembly comprises a housing, a cover, and a window. The housing comprises an opening to support a beacon within the housing. The opening comprises a first edge having an opening notch formed therein. The cover comprises first edge having a cover notch formed therein and corresponding to the opening notch so that the opening notch is proximate and substantially parallel to the cover notch when the cover is placed over the opening. The window is disposed between the opening notch and the cover notch. The drill bit is connected to the beacon assembly.

DESCRIPTION OF THE PREFERRED EMBODIMENT

Horizontal directional drilling tools used in directional drilling for placement of buried utility lines typically contain beacons within a housing formed in the front of the tool. These beacons are used to detect the position of the tool underground. Such beacons are valuable and fragile electronic devices that should be protected within high strength alloy housings. These housing are preferably capable of transferring torque and thrust forces that are applied at their rear by the drill string during drilling operations. Additionally, localized crushing forces generated on the housing when the drill bit passes between rock and boulders is considerable. High forces from such regularly encountered obstructions accelerate wear to the beacon and housing. The present invention provides greater protection of the beacon during drilling operations by isolating the beacon from physical shock. Cushioning the ends of the beacon with isolators inside the housing reduces the forces experienced by the beacon during operation and results in longer beacon life.

To operate, the beacon must be capable of transmitting a signal to the receiver above ground. Generally, beacons used in HDD operations transmit an electromagnetic signal through the housing to the receiver. In order to transmit the electromagnetic signal through the housing, a transmission window is formed in the housing adjacent the beacon. Such windows are normally slots formed in the housing or housing cover that are elongated and fairly narrow in width. The slot adds cost to manufacturing as generally a special machining operation must be setup to manufacture this feature. The slot also detracts from the strength of the housing or cover. The present invention solves these problems by providing windows not in the cover or housing but in the mating of adjacent edges of the housing cover and the opening of the housing. Such design provides more economical manufacturing and minimizes the structural effect of windows on the housing and cover.

Figure 1:
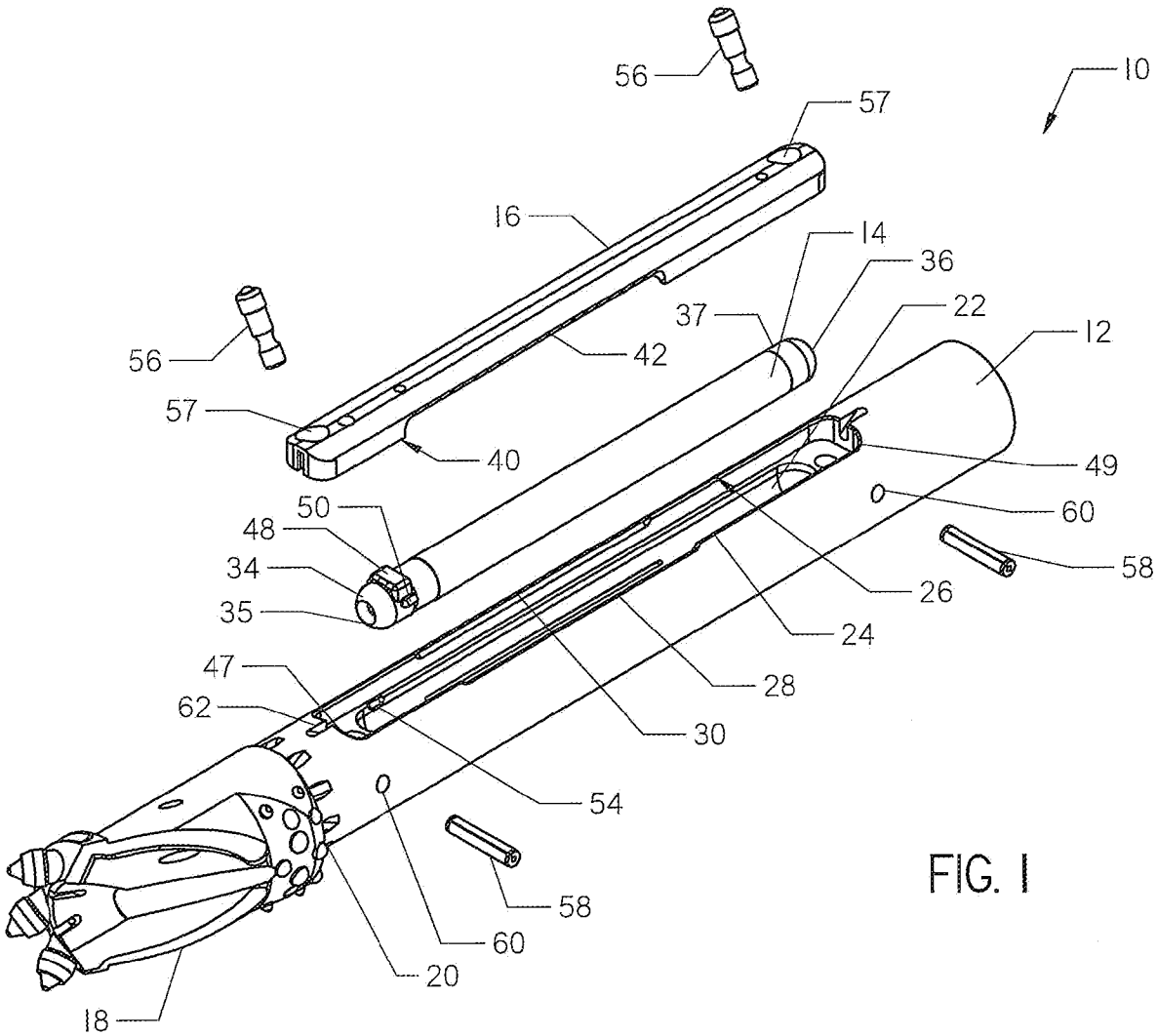
FIG. 1 is a partially exploded isometric view of the beacon assembly of the present invention.

With reference to FIG. 1, a partially exploded isometric view of a beacon assembly 10 constructed in accordance with the present invention is shown. The beacon assembly 10 comprises a housing 12, a beacon 14, and a cover 16. A drill bit 18 is shown attached to a forward end 20 of the housing 12. The drill bit 18 may comprise a directional drill bit having a slanted surface, a drag bit, or a roller bit. The drill bit 18 may be connected to the forward end 20 using a threaded connection or a splined connection as shown in FIG. 1.

The housing 12 comprises an opening 22 to support the beacon within the housing. The opening comprises an edge 24 having an opening notch 28 formed therein. As shown, the housing 12 further comprises a second opening edge 26. A second opening notch 30 is formed within the second opening edge 26.

The beacon 14 comprises an electromagnetic transmitter (not shown) and an orientation sensor package (not shown). The transmitter and sensors are used to track the beacon 14, housing 12, and drill bit 18 as they move through the ground. The beacon 14 of FIG. 1 may comprise a forward isolator 34 attached to a forward end 35 of the beacon, and a rearward isolator 36 attached to the rearward end of the beacon 37. The forward isolator 34 and the rearward isolator 36 are disposed on opposite ends of the beacon 14 to isolate the beacon from shock during boring operations. As shown, the forward isolator 34 and rearward isolator 36 have a generally hemispherical shape. The rearward isolator 36 may support a battery (not shown) for powering the beacon 14. Alternatively, the battery may be provided in the forward isolator 34 or power may be provided to the beacon 14 from outside the beacon 14.

Figure 3:
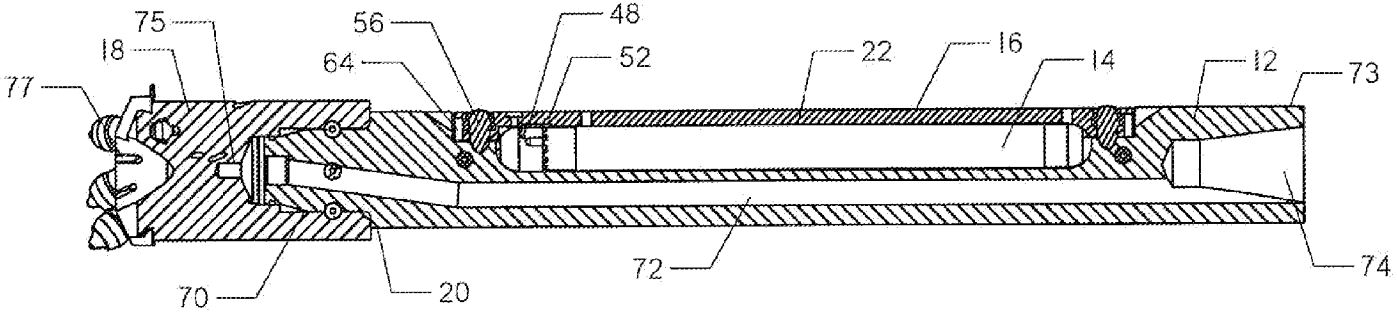
FIG. 3 is a lengthwise sectional view along line C-C of FIG. 2.

With continued reference to FIG. 1, the forward isolator 34 is adapted to fit into a forward end 47 of the opening 22. The rearward isolator 36 may fit into a rearward end 49 of the opening 22. The beacon 14 is disposed within the housing 14 during drilling and supported in the opening 22. The forward isolator 34 comprises a cover key 48. The cover key 48 is configured to mate with a cover isolator socket 52 (FIG. 3). Symmetrical locators 50 formed on both sides of the cover key 48 are configured to mate with locator sockets 54 formed within the opening 22. The mating of the cover key 48 with the cover isolator socket 52 (FIG. 3) and the mating of the symmetrical locators 50 with the locator sockets 54 prevents the beacon 14 from rotating within the opening 22 and orients the beacon relative to the drill bit 18.

Figure 2:
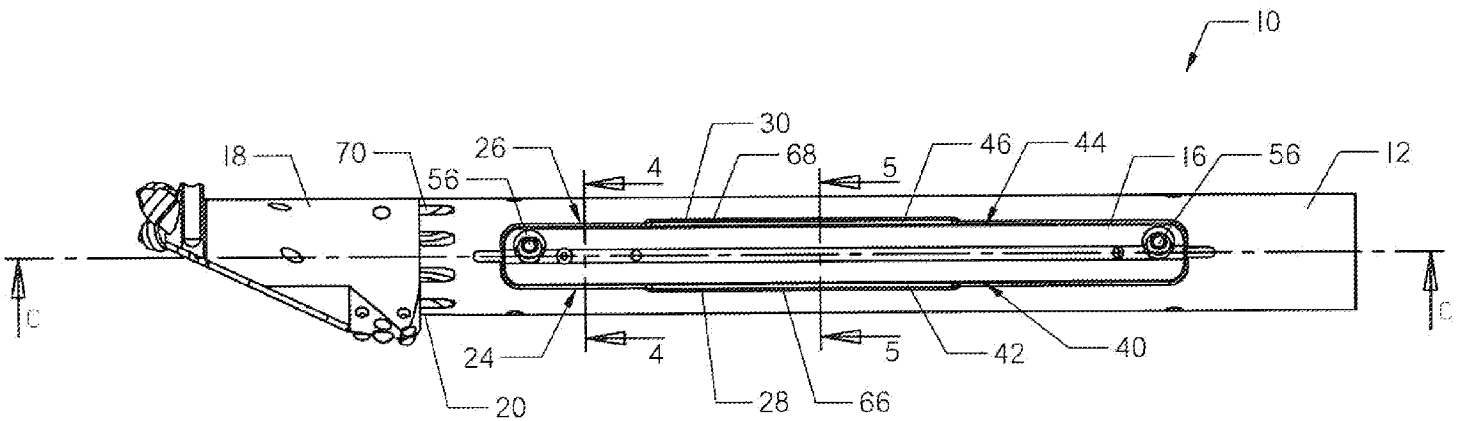
FIG. 2 is side view of the beacon assembly of FIG. 1.

The cover 16 comprises a first edge 40 having a cover notch 42 formed therein and corresponding to the opening notch 28 so that the opening notch is proximate and substantially parallel to the cover notch when the cover notch is connected to the housing 12. As shown in FIG. 2, the cover 16 comprises a second edge 44 defining a second cover notch 46.

The cover 16 connects to the housing 12 to cover substantially the entire opening 22. The cover 16 is secured to the housing 12 by retaining pins 56 and the mating of the cover key 48 and cover isolator socket 52 (FIG. 3). The retaining pins 56 may be installed through holes 57 formed in the cover 16 and into the housing 12. The housing 12 defines at least one lateral bore 60. As shown, a coil pin 58 may be inserted into the at least one bore 60 to engage the retaining pins 56 and further secure the cover 16. To access the beacon 14, after boring operations, the coil pins 58 are driven from the bores 60, and a pry slot 62 along with an adjacent pry groove 64 may be used to gain leverage to pry the cover 16 from the housing 12. The notches 28, 30, 42 and 46 formed within the edges 24, 26, 40, and 44 of the cover 16 and the opening 22 may also be used to help pry the cover 16 from the housing 12.

Turning now to FIG. 2, a side view of the beacon assembly 10 is shown with a drill bit 18 attached to the forward end of the housing 12. The drill bit 18 is attached to the housing using a non-indexable spline 70, as described in U.S. Pat. No. 6,148,935 incorporated herein. The cover 16 is shown covering the opening 22. The retaining pins 56 are placed through the holes 57 formed in the cover 16. The cover notch 42 of the first edge 40 is shown aligned with the opening notch 28 of the opening edge 24. The opening notch 28 of the opening edge 24 is proximate and substantially parallel to the cover notch 42 of the first edge 40. The alignment of cover notch 42 and opening notch 28 form a window 66. The alignment of the second cover notch 46 of the second edge 44 with the second opening notch 30 of the second opening edge 26 forms a second window 68. The windows 66 and 68 allow for transmission of the electromagnetic signal from the housing 12 to the above-ground receiver. Manufacturing of the beacon assembly 10 is simplified by forming transmission windows using notches on the cover 16 and the opening 22; a separate manufacturing step to form a window in the housing 12 is not required. Forming the windows 66 and 68 via edges of the cover 16 and the housing opening 22, rather than forming them in the center of the cover 16 and the opening 22, increases the structural integrity of the housing 12 and cover 16.

With reference now to FIG. 3, longitudinal sections of the beacon assembly 10 and drill bit 18 are shown. As shown in FIG. 3, the housing 12 has a fluid passage 72 that extends from the forward end 20 of the housing 12 to a rearward end 73 of the housing. The fluid passage 72 may be integrally formed with a threaded socket 74. The fluid passage 72 conducts fluid such as drilling mud from the threaded socket 74 to fluid passage 75 formed in the drill bit 18. The fluid is discharged through nozzles 77 formed in the drill bit 18.

The cover 16 is shown covering the opening 22 and securing the beacon 14 within the housing 12. The cover 16 is secured by retaining pins 56 and the mating of door key 48 with cover isolator socket 52.

Figure 4:
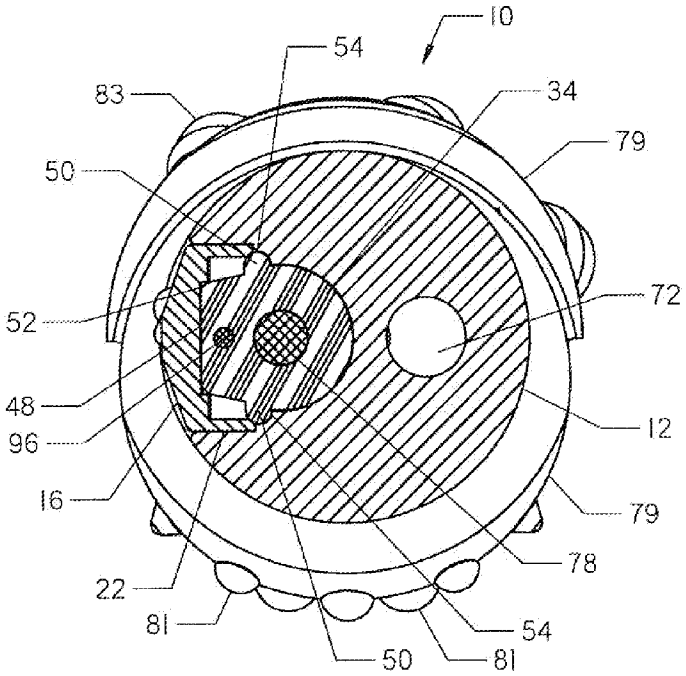
FIG. 4 is a cross-section view along line 4-4 of FIG. 2.

With reference to FIG. 4, the beacon assembly 10 is shown in a cross-section along line 4-4 of FIG. 2 at the forward isolator 34. Cover 16 is shown secured within the opening 22. A shaft 78 fits tightly in the center of the forward isolator 34 to help orient and secure the beacon 14 within the housing 12. An indexing pin 96 also fits into the forward isolator 34 and is used for orienting and securing the beacon 14 within the housing 12. Symmetrical locators 50 are shown mating with locator sockets 54 to stabilize and secure the beacon 14 within the housing 12. Door key 48 is shown mating with cover isolator socket 52. Fluid passage 72 is shown passing through the housing 12. A crushing surface 79 is shown around the outside diameter of the housing 12. Crushing surface 79 defines the outermost diameter of the drill bit 18 and is preferably studded with a plurality of carbides 81. The carbides 81 work to reduce wear on the crushing surface 79 of the drill bit 18 and to grind cuttings passed back from the front of the drill bit 18. At the front of the drill bit 18 is at least one cutting tooth 83. The cutting tooth 83 works to crush the underground terrain to initiate the creation of a borehole.

Figure 5:
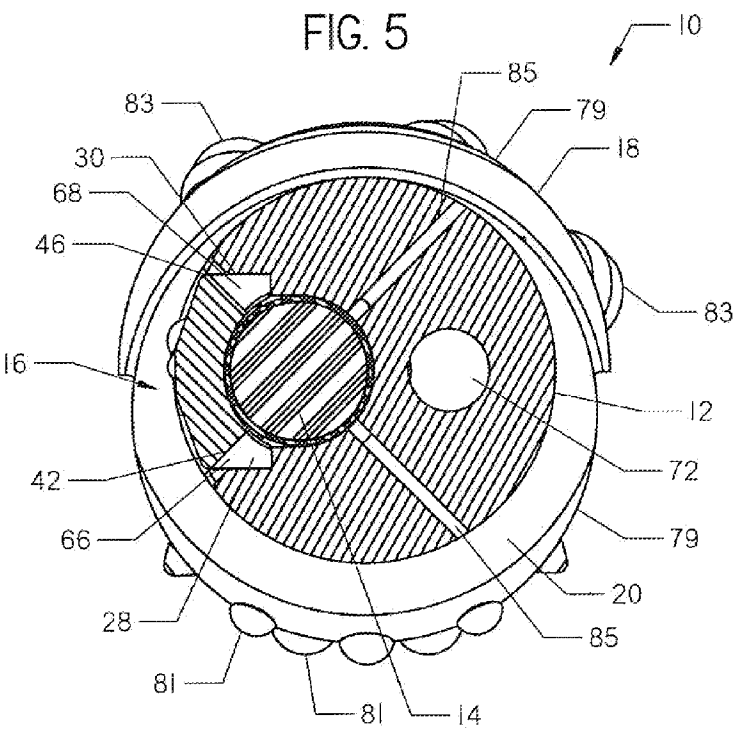
FIG. 5 is a cross-section view along line 5-5 of FIG. 2.

With reference to FIG. 5, the beacon assembly 10 is shown in cross-section along line 5-5 of FIG. 2. The cover notch 42 and opening notch 28 define the window 66, while the second cover notch 46 and second opening notch 30 define the second window 68. The cover 16 is shown securing the beacon 14 within the housing 12. Fluid passage 72 is also shown. If needed, additional windows 85 may also be formed in the sides of the housing to give additional area for the electromagnetic signal to transmit from the beacon 14 to the above-ground receiver.

Figure 6:
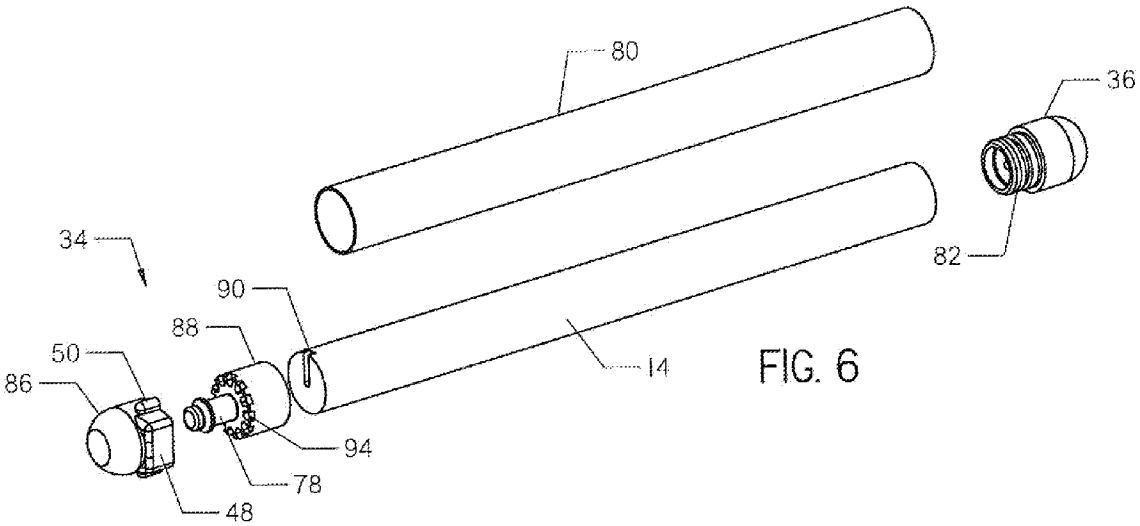
FIG. 6 is a front isometric partially exploded view of a beacon and a forward and a rearward isolator.
Figure 7:
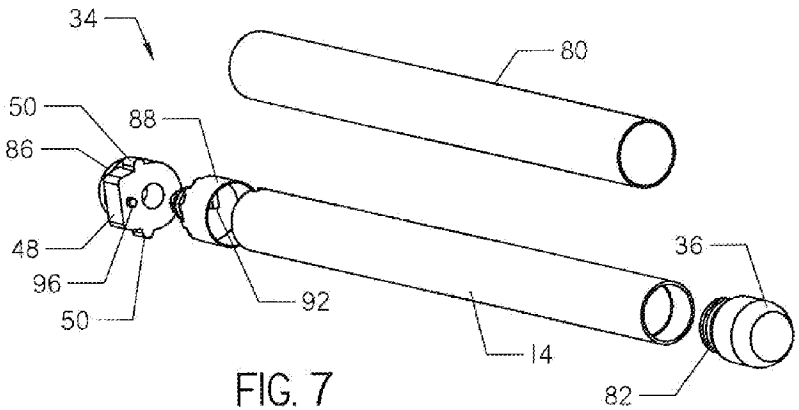
FIG. 7 is a rear isometric partially exploded view of the beacon and isolators shown in FIG. 6.
Figure 8:
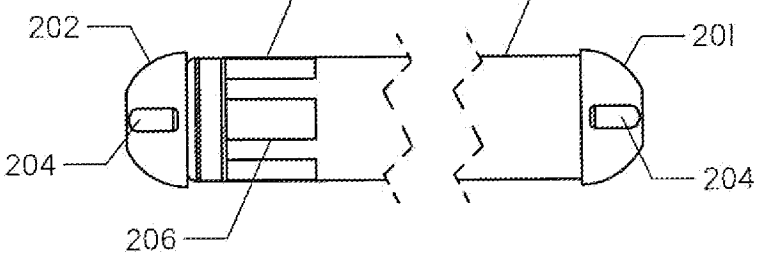
FIG. 8 is a top view of another embodiment of the beacon of the present invention.
Figure 10:
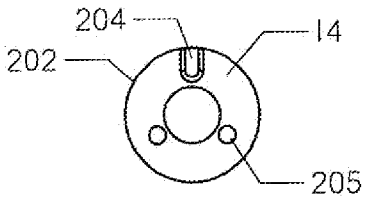
FIG. 10 is a front view of another embodiment of the beacon of the present invention.
Figure 9:
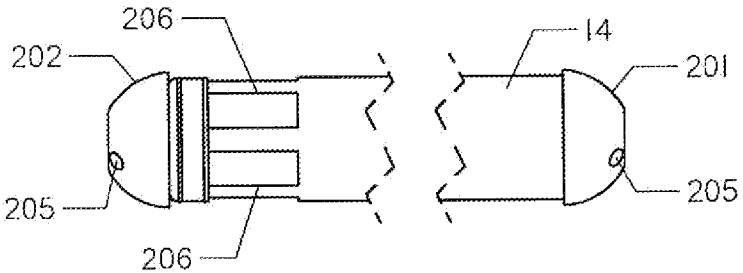
FIG. 9 is a bottom view of another embodiment of the beacon of the present invention.
Figure 11:
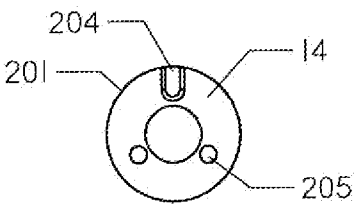
FIG. 11 is a rear view of another embodiment of the beacon of the present invention.

With reference to FIGS. 6, and 7 the beacon 14 is shown in partially exploded form. The beacon 14 may comprise an optional protective sleeve 80. The rearward isolator 36 comprises a threaded end 82 configured to attach to the beacon 14.

The forward isolator 34 is shown in detail in FIG. 6. The forward isolator 34 comprises a front end 86, a forward isolator mounting sleeve 88, and a tab 92 (FIG. 7). The mounting sleeve 88 fits over the diameter of the beacon 14 and comprises at least one slot 94 for engaging with the indexing pin 96 on the front end 86 of the forward isolator 34. As shown, beacon 14 comprises a slot 90. Slot 90 engages tab 92 to orient the beacon 14 to the mounting sleeve 88. The shaft 78 on the mounting sleeve 88 couples with the front end 86 of the forward isolator 34 to help orient and isolate the beacon 14 from physical shock.

Turning now to FIGS. 8, 9, 10, and 11, an alternative rearward isolator 201 and an alternative forward isolator 202 are shown attached to the beacon 14. The rearward isolator 201 and forward isolator 202 are mounted on opposite ends of the beacon 14. The rearward isolator 201 and forward isolator 202 each comprise notches 204 for engagement with mounting tabs (not shown) formed in the housing 12 (not shown). The notches 204 serve as clocking mechanisms to help orient and stabilize the beacon 14 within the housing 12. At least one bore 205 is formed on both the rearward isolator 201 and the forward isolator 202 for receiving screws (not shown) to keep the beacon 14 and isolators 201 and 202 stable inside the housing. The beacon 14 may also be formed with at least one indention 206. The indention 206 gives space for a wrench to grip and remove isolator 202 and a battery cover (not shown) from the beacon 14 if needed.

The preferred invention includes a method comprising securing the forward isolator 34 to the forward end of the beacon 14 and securing the rearward isolator 36 to the rearward end of the beacon 14. The beacon 14 along with the forward and rearward isolators 34 and 36 are then placed into the housing 12 through the opening 22 and secured to the forward end 47 and rearward end 49 of the opening 22 via symmetrical locators 50 and locator sockets 54. The cover 16 may then be placed over the opening 22 and secured to the housing 12 via the cover key 48 and the cover isolator socket 52. Retaining pins 56 are installed through holes 57 formed in the cover 16 and into the housing 12 to secure the cover 16 to the housing. Coil pin 58 may be inserted into lateral bore 60 formed in the housing to hold the retaining pins 56 in place. Windows 66 and 68 are formed by the alignment of cover notch 42 with opening notch 28 and the alignment of second cover 46 with second opening notch 30. The windows 66 and 68 allow for transmission of the electromagnetic signal from the housing 12 to the above-ground receiver. The receiver can then determine the position of the beacon underground.

Although the present invention has been described with respect to the preferred embodiment, various changes and modifications may be suggested to one skilled in the art, and it is intended that the present invention encompass such changes and modifications as fall within the scope of this disclosure.

What is claimed is:

1. A beacon assembly for use in directional boring comprising:

a housing comprising an opening to support a beacon within the housing, the opening comprising an edge having an opening notch foamed therein;

wherein a length of the edge and a length of the opening notch extend along a longitudinal axis of the housing;

a cover comprising a first edge having a length extending along a longitudinal axis of the cover and having a cover notch formed therein and corresponding to the opening notch so that the opening notch is proximate and substantially parallel to the cover notch when the cover is placed over the opening; and a window disposed between the opening notch and the cover notch.

2. The beacon assembly of claim 1 further comprising:

a forward isolator attached to a forward end of the beacon; and a rearward isolator attached to a rearward end of the beacon, wherein the forward isolator and the rearward isolator isolate the beacon from mechanical shock in the housing.

3. The beacon assembly of claim 1 wherein the cover comprises a second edge.

4. The beacon assembly of claim 3 comprising a second window proximate the second edge of the cover.

5. The beacon assembly of claim 1 wherein the opening comprises a second edge.

6. The beacon assembly of claim 5 comprising a second window proximate the second edge of the opening.

7. The beacon assembly of claim 1 wherein the window is a slot formed by the cover notch and the opening notch.

8. A method for isolating a beacon within a housing comprising the steps of:

securing a forward isolator and a rearward isolator to opposite ends of the beacon;

wherein the forward isolator comprises a cover key;

providing an opening within the housing configured for receiving the beacon, wherein the opening comprises a forward and rearward end;

providing the opening with an edge having an opening notch formed therein, wherein a length of the edge and a length of the opening notch extend along a longitudinal axis of the housing;

configuring the forward and the rearward end of the opening to allow the forward end to mate with the forward isolator and the rearward end to mate with the rearward isolator;

placing the beacon within the opening such that the forward isolator on the beacon mates with the forward end of the opening and the rearward isolator on the beacon mates with the rearward end of the opening;

placing a cover over the beacon such that the cover key on the forward isolator mates with a cover isolator socket formed on the cover; and providing the cover with a first edge having a length extending along a longitudinal axis of the cover and having a cover notch formed therein and corresponding to the opening notch so that the opening notch is proximate and substantially parallel to the cover notch when the cover is placed over the opening such that a window is formed between the opening notch and the cover notch.

9. The method of claim 8 wherein orientation of the beacon is chosen by mating one of a plurality of slots located on a portion of the forward isolator with a pin located on a second portion of a forward isolator.

10. A horizontal directional drilling system comprising:

a rotary drive machine;

a drill string attached to the rotary drive machine at an uphole end of the drill string;

a beacon assembly attached to a downhole end of the drill string, the beacon assembly comprising:

a housing comprising an opening to support a beacon within the housing, the opening comprising an edge having an opening notch formed therein; wherein a length of the edge and a length of the opening notch extend along a longitudinal axis of the housing;

a cover comprising a first edge having a length extending along a longitudinal axis of the cover and having a cover notch formed therein and corresponding to the opening notch so that the opening notch is proximate and substantially parallel to the cover notch when the cover is placed over the opening; and a window disposed between the opening notch and the cover notch; and a drill bit connected to the beacon assembly.

11. The horizontal directional drilling system of claim 10 wherein, the beacon assembly further comprises:

a forward isolator attached to a forward end of the beacon; and a rearward isolator attached to a rearward end of the beacon, wherein the forward isolator and the rearward isolator isolate the beacon from mechanical shock in the housing.

12. The horizontal directional drilling system of claim 10 wherein the cover comprises a second edge.

13. The horizontal directional drilling system of claim 12 comprising a second window proximate the second edge of the cover.

14. The horizontal directional drilling system of claim 10 wherein the opening comprises a second edge.

15. The horizontal directional drilling system of claim 14 comprising a second window proximate the second edge of the opening.

16. The horizontal directional drilling system of claim 10 wherein the window is a slot formed by the cover notch and the opening notch.

* * * * *

UNITED STATES PATENT AND TRADEMARK OFFICE

CERTIFICATE OF CORRECTION

PATENT NO. : 8,955,586 B1
APPLICATION NO. : 13/357226
DATED : February 17, 2015
INVENTOR(S) : Mark D. Randa, Robert F. Crane and Steven W. Wentworth It is certified that error appears in the above-identified patent and that said Letters Patent is hereby corrected as shown below:

In the Claims

Column 5, claim 1, line 48, please delete "foamed" and substitute therefore --formed--.

Signed and Sealed this
Nineteenth Day of May, 2015

Michelle K. Lee

Michelle K. Lee
*Director of the United States Patent and Trademark Office*